US007904006B2

(12) United States Patent
Muramatsu

(10) Patent No.: US 7,904,006 B2
(45) Date of Patent: Mar. 8, 2011

(54) DEVELOPER REPLENISHING DEVICE FOR IMAGE FORMING APPARATUS

(75) Inventor: Satoshi Muramatsu, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 243 days.

(21) Appl. No.: 11/931,025

(22) Filed: Oct. 31, 2007

(65) Prior Publication Data

US 2008/0219683 A1 Sep. 11, 2008

(30) Foreign Application Priority Data

Nov. 1, 2006 (JP) ..... 2006-298062
Jun. 20, 2007 (JP) ..... 2007-162147

(51) Int. Cl.
*G03G 15/08* (2006.01)

(52) U.S. Cl. ..... 399/262; 399/120

(58) Field of Classification Search ..... 399/27, 399/119, 120, 262, 263
See application file for complete search history.

(56) References Cited

U.S. PATENT DOCUMENTS 4,766,457 A * 8/1988 Barker et al. ..... 399/262 X
5,426,492 A * 6/1995 Diehl ..... 399/262
5,797,074 A 8/1998 Kasahara et al.
5,960,246 A 9/1999 Kasahara et al.
6,418,284 B1 * 7/2002 Mercer ..... 399/120
6,526,246 B2 2/2003 Iwata et al.
6,542,707 B2 4/2003 Muramatsu et al.
6,597,883 B2 7/2003 Muramatsu et al.
6,608,983 B2 8/2003 Terazawa et al.
6,628,908 B2 * 9/2003 Matsumoto et al. ..... 399/262 X
6,628,913 B2 9/2003 Matsumoto et al.
6,678,492 B1 1/2004 Terazawa et al.
6,785,496 B2 * 8/2004 Iwata et al. ..... 399/120 X
6,813,460 B2 * 11/2004 Sudo et al. ..... 399/262 X
6,826,381 B2 11/2004 Muramatsu et al.
6,879,804 B2 * 4/2005 Park ..... 399/120 X
6,898,405 B2 5/2005 Matsumoto et al.
6,904,249 B2 * 6/2005 Kato et al. ..... 399/120
6,934,490 B2 * 8/2005 Koyama et al. ..... 399/120
7,065,313 B2 6/2006 Matsumoto et al.
7,116,928 B2 10/2006 Muramatsu et al.

(Continued)

FOREIGN PATENT DOCUMENTS

JP 63-10424 3/1988

(Continued)

*Primary Examiner* — Sandra L Brase
(74) *Attorney, Agent, or Firm* — Oblon, Spivak, McClelland, Maier & Neustadt, L.L.P.

(57) ABSTRACT

A toner replenishing device that provides a container and a device having a high toner volumetric efficiency and a low cost, suppresses vibration during replenishment to a minimum, and stores recovered toner without impairing the volumetric efficiency of unused toner is constituted by a developer replenishing device which is provided with a developer container storing a developer used in an image forming apparatus and replenishes a developing device of the image forming apparatus with the developer in the developer container. The developer container is rectangular in a horizontal direction, and comprises an outside container storing unused developer and a deformable inside container enveloped by the outside container. The developer replenishing device comprises a developer discharging mouthpiece portion for discharging the developer from the interior of the container, which is provided in a lengthwise direction end portion of the outside container, an air supply nozzle, provided in an opposite side end portion to the developer discharging mouthpiece portion in the lengthwise direction, for introducing air into the inside container, and an air pump for supplying air to the supply nozzle.

18 Claims, 8 Drawing Sheets

U.S. PATENT DOCUMENTS

| | | | |
|---|---|---|---|
| 7,127,198 | B2 | 10/2006 | Muramatsu et al. |
| 7,245,853 | B2 | 7/2007 | Muramatsu et al. |
| 7,277,665 | B2 | 10/2007 | Terazawa et al. |
| 2003/0235436 | A1 | 12/2003 | Kasahara et al. |
| 2005/0281592 | A1 | 12/2005 | Muramatsu et al. |
| 2007/0009289 | A1 | 1/2007 | Muramatsu et al. |
| 2007/0092303 | A1 | 4/2007 | Katsuyama et al. |

FOREIGN PATENT DOCUMENTS

| | | |
|---|---|---|
| JP | 2002-148924 | 5/2002 |
| JP | 2003-98813 | 4/2003 |
| JP | 2005-292300 | 10/2005 |

* cited by examiner

DEVELOPER REPLENISHING DEVICE FOR IMAGE FORMING APPARATUS

BACKGROUND OF THE INVENTION

1. Field of the Invention

The present invention relates to an electrophotographic image forming apparatus such as an electrophotographic copier, a printer, a facsimile device, and a compound device thereof, and more particularly to a developer replenishing device suitable for use in this image forming apparatus.

2. Description of the Related Art

In an electrophotographic image forming apparatus, an image is typically created by forming a toner image using a so-called developer containing a toner and a carrier. The toner is steadily consumed as image formation progresses, and therefore a toner storage container serving as a toner cartridge filled with toner is generally used, and when all of the toner in the toner storage container has been consumed, new toner is supplied by replacing the toner storage container with a new toner storage container.

Since toner is a powder, it is important to discharge the toner such that as little toner as possible remains in the toner storage container. Conventional methods for conveying toner from the interior of the container to a container outlet portion include a method of providing a screw known as an auger in the interior of the container and conveying the toner in a single direction by rotating the screw, a method of providing a spiral projection known as a screw bottle on the inner surface of a cylindrical portion of a tubular container and rotating the container such that the toner is conveyed little by little to an outlet portion of the container, and so on.

The present inventor has proposed a method of discharging toner from a toner storage container by applying acceleration to the toner storage container through an asymmetric reciprocating motion such that the toner in the container is moved in a single direction by inertia and discharged through a discharge port provided in the downward direction of the container.

In the toner conveyance method employing an auger, a member must be provided in the interior of the container and rotated, and therefore the structure of the container becomes complicated. In the toner conveyance method employing a screw bottle, no member need be provided in the interior of the container, and therefore the structure of the container is simple, but since the container is rotated, the container must be formed with a cylindrical main body and provided with an outlet in one end surface (the shape of a normal bottle laid on its side). Hence, in comparison with a rectangular parallelepiped-shaped container, the amount of toner that can be stored in the container is small, the container is not easy to hold and may slip out of the hand during replacement, and so on.

Meanwhile, with the method of applying a reciprocating motion (in the lateral direction) to the container to move the toner inside the container such that the toner is discharged through a discharge port provided in the lower side of the container (to be referred to hereafter as a reciprocation method) a simple container shape such as a rectangular parallelepiped that can hold a large amount of toner (that has little dead space) may be employed, and since there is no need to provide a conveyor member inside the container, a low-cost, compact replenishing device can be realized. Moreover, a bag-shaped container constituted by a flexible sheet may be used, enabling savings in natural resources and costs.

However, a reciprocation type replenishing device is greatly disadvantaged in that the resultant vibration causes abnormal images (banding). Hence, to cancel out the effect of vibration generated during reciprocation of the container on the main body, a method of providing a movable stopper and causing the container and stopper to collide at opposite phase speeds has been proposed. However, even slight vibration affects image formation, and therefore a replenishment method in which vibration is reduced to the greatest extent possible is required.

Meanwhile, during image formation, residual toner is generated following transfer, and conventionally, this residual toner is recovered in a recovery bottle. A method of provided the container with a recovery chamber in advance and recovering the residual toner in the container has also been proposed, but when this method is employed, the constitution of a residual toner moving device and the capacity of the container decrease, and the cost of the container rises due to its complexity. It is therefore difficult to incorporate this method into an actual product.

Technologies relating to the present invention are also disclosed in, e.g., Japanese Unexamined Patent Application Publication 2003-098813, Japanese Unexamined Patent Application Publication 2005-292300, Japanese Unexamined Patent Application Publication S63-010424, and Japanese Unexamined Patent Application Publication 2002-148924.

SUMMARY OF THE INVENTION

It is an object of the present invention to provide a toner replenishing device for an image forming apparatus which can solve the conventional problems described above by realizing a container and a device having a high toner volumetric efficiency and a low cost, suppressing vibration during toner replenishment to a minimum, and storing recovered toner without impairing the volumetric efficiency of unused toner.

In an aspect of the present invention, a developer replenishing device is provided with a developer container storing a developer used in an image forming apparatus, and replenishes a developing device of the image forming apparatus with the developer in the developer container. The developer container is rectangular in a horizontal direction, and comprises an outside container storing unused developer and a deformable inside container enveloped by the outside container. The developer replenishing device comprises a developer discharge port, provided in the outside container, for discharging the developer from the interior of the outside container; an air supply port for introducing air into the inside container; and air supplying means for supplying air to the air supply port.

In another aspect of the present invention, a developer container stores a developer used in an image forming apparatus. The developer container is rectangular in a horizontal direction, and comprises an outside container storing unused developer and a deformable inside container enveloped by the outside container, and further comprises a developer discharge port, provided in the outside container, for discharging the developer from the interior of the outside container; and an air supply port for introducing air into the inside container.

In another aspect of the present invention, an image forming apparatus uses a developer replenishing device. The developer replenishing device is provided with a developer container storing a developer used in the image forming apparatus, and replenishes a developing device of the image forming apparatus with the developer in the developer container. The developer container is rectangular in a horizontal direction, and comprises an outside container storing unused developer and a deformable inside container enveloped by the outside container. The developer replenishing device comprises a developer discharge port, provided in the outside container, for discharging the developer from the interior of the outside container; an air supply port for introducing air into the inside container; and air supplying means for supplying air to the air supply port.

BRIEF DESCRIPTION OF THE DRAWINGS

The above and other objects, features and advantages of the present invention will become more apparent from the following detailed description taken with the accompanying drawings, in which.

DESCRIPTION OF THE PREFERRED EMBODIMENTS

Embodiments of the present invention will be described below on the basis of the attached drawings.

First Embodiment

Figure 1:
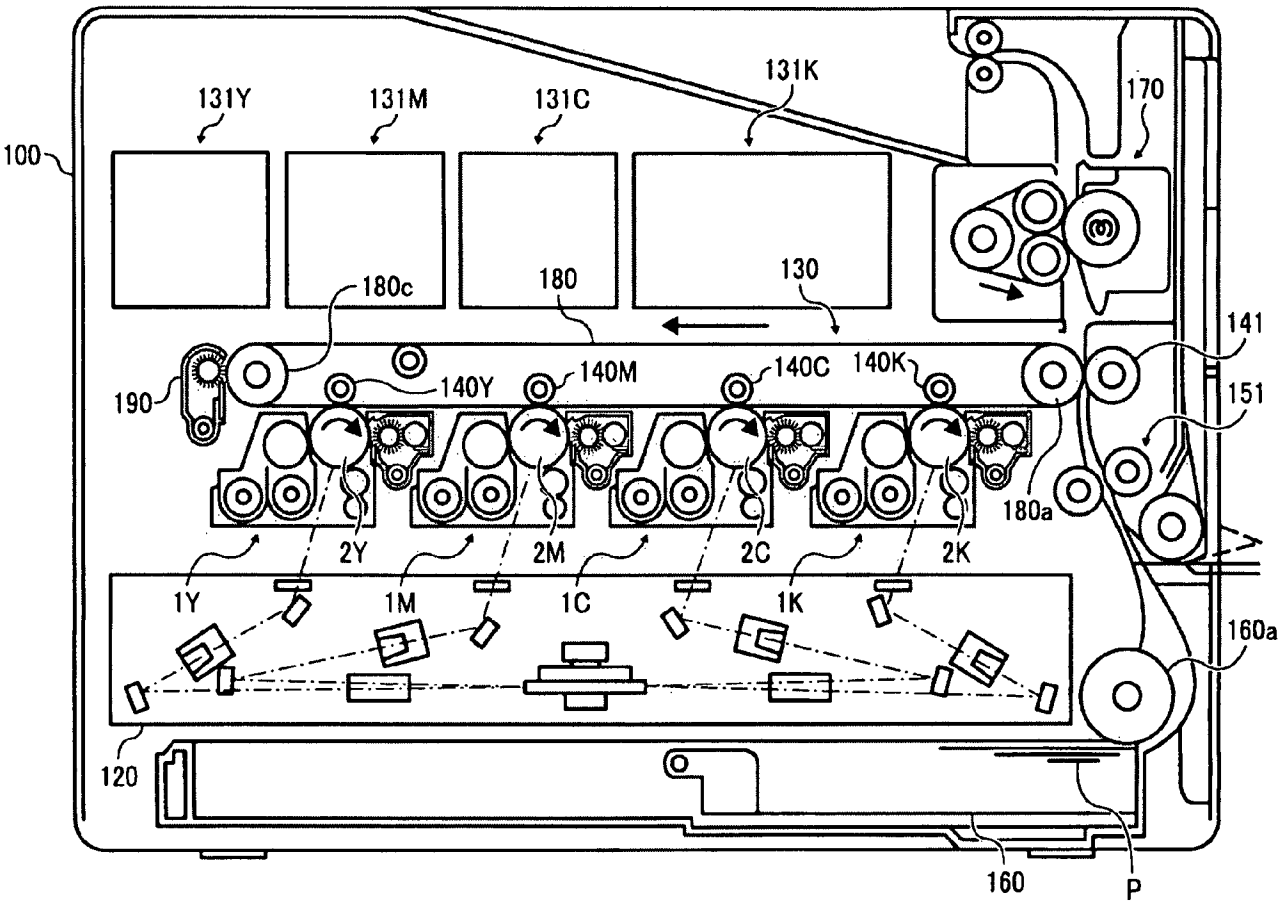
FIG. 1 is a view showing the overall constitution of an image forming apparatus (printer) to which the present invention is applied.

FIG. 1 shows the overall constitution of an image forming apparatus (printer) to which this embodiment is applied. As shown in the drawing, in this image forming apparatus, four toner containers 131Y, 131M, 131C, 131K corresponding to four colors (yellow, magenta, cyan, black) are disposed detachably (replaceably) in a toner container storage portion above an image forming apparatus main body 100. An intermediate transfer unit 130 is disposed beneath the toner container storage portion, and image creating portions 1Y, 1M, 1C, 1K corresponding to the four colors (yellow, magenta, cyan, black) are arranged in series so as to face an intermediate transfer belt 180 of the intermediate transfer unit 130.

For example, the image creating portion 1Y corresponding to yellow is constituted by a photosensitive drum 2Y, and a charging portion, a developing device (development portion), a cleaning portion, a neutralizing portion (not shown), and so on, which are arranged around the photosensitive drum 2Y. Image creating processes (a charging process, an exposure process, a development process, a transfer process and a cleaning process) are implemented on the photosensitive drum 2Y to form a yellow image on the photosensitive drum 2Y. Apart from the color of the used toner, the other three image creating portions 1M, 1C, 1K have a substantially identical constitution to the image creating portion 1Y corresponding to yellow, and respectively form images in the corresponding toner colors. Accordingly, in the following description, the symbols Y, M, C, K denoting the colors will be omitted except where necessary.

The photosensitive drum 2 is driven to rotate in the clockwise direction of the drawing by a drive motor, not shown in the drawing. Then, in the position of the charging portion, the surface of the photosensitive drum 2 is uniformly charged (charging process). An electrostatic latent image corresponding to yellow is then formed on the surface of the photosensitive drum 2 by exposing and scanning the surface of the photosensitive drum 2 with a laser beam emitted from an exposing device 120 in an irradiation position (exposure process).

Next, the electrostatic latent image on the surface of the photosensitive drum 2 is developed in a position facing the developing device to form a yellow toner image (development process). The toner image on the photosensitive drum 2 is then transferred onto the intermediate transfer belt 180 in a position facing the intermediate transfer belt 180 and a primary transfer bias rollers 140Y, 140M, 140C, 140K (primary transfer process).

At this time, a small amount of non-transferred toner remains on the photosensitive drum 2. However, the non-transferred toner remaining on the photosensitive drum 2 is then mechanically recovered by a cleaning blade in a position facing the cleaning portion (cleaning process). Finally, the remaining potential on the photosensitive drum 2 is removed in a position facing the neutralizing portion, not shown in the drawing, whereupon the series of image creating processes executed on the photosensitive drum 2 is terminated.

The other image creating portions 1M, 1C, 1K perform the image creating processes described above in a similar manner to the yellow image creating portion 1Y, whereupon the toner image of each color formed on the respective photosensitive drums 2 are superposed onto the intermediate transfer belt 180 such that a color image is formed on the intermediate transfer belt 180.

The intermediate transfer unit 130 is constituted by the intermediate transfer belt 180, four primary transfer bias rollers, a secondary transfer backup roller 180*a*, a cleaning backup roller, a tension roller 180*c*, an intermediate transfer cleaning portion 190, and so on. The intermediate transfer belt 180 is stretched and supported by the two rollers 180*a*, 180*c*, and is moved in the direction of the arrow in FIG. 1 when one of the rollers is driven to rotate.

The four primary transfer bias rollers 140Y, 140M, 140C, 140K sandwich the intermediate transfer belt 180 on the opposite side of the photosensitive drum 2 to form a primary transfer nip. A transfer bias having a reverse polarity to the polarity of the toner is applied to the primary transfer bias roller 140. The intermediate transfer belt 180 travels in the direction of the arrow in the drawing, thereby passing through the primary transfer nip of each primary transfer bias roller 140 in sequence, and thus the toner images of the four colors on the respective photosensitive drums 2 are subjected to primary transfer so as to be superposed onto the intermediate transfer belt 180.

Next, in the position of a secondary transfer nip formed by sandwiching the intermediate transfer belt 180 between the secondary transfer backup roller 180*a* and a secondary transfer roller 141, the color toner image formed on the intermediate transfer belt 180 is transferred onto a copying subject material P such as transfer paper that has been conveyed to the position of the secondary transfer nip.

At this time, non-transferred toner that has not been transferred onto the copying subject material P remains on the intermediate transfer belt 180, and therefore the non-transferred toner on the intermediate transfer belt 180 is recovered in the position of the intermediate transfer cleaning portion 190, whereupon the series of transfer processes executed on the intermediate transfer belt 180 is terminated.

Note that the copying subject material P conveyed to the position of the secondary transfer nip is conveyed from a tray 160 disposed beneath the apparatus main body via a feed roller 160*a*, a registration roller pair 151, and so on. A plurality of sheets of the copying subject material P such as transfer paper are stacked and stored on the tray 160, and by driving the feed roller 160*a* to rotate in the counter-clockwise direction of FIG. 1, the uppermost sheet of the copying subject material P is fed between the rollers of the registration roller pair 151.

The copying subject material P conveyed to the registration roller pair 151 is halted temporarily in the position of a roller nip formed when rotation of the registration roller pair 151 is halted, and at a timing corresponding to the color image on the intermediate transfer belt 180, the registration roller pair 151 are driven to rotate such that the copying subject material P is conveyed toward the secondary transfer nip.

Once the color image has been transferred onto the copying subject material P in the position of the secondary transfer nip, the copying subject material P is conveyed to a fixing portion 170, where heat and pressure are supplied from a fixing roller, a pressure roller, and so on to fix the color image transferred onto the surface. The copying subject material P is then discharged to the exterior of the apparatus via a discharge roller pair, and stacked. At this point, the series of image forming processes executed by the image forming apparatus is terminated.

Figure 2:
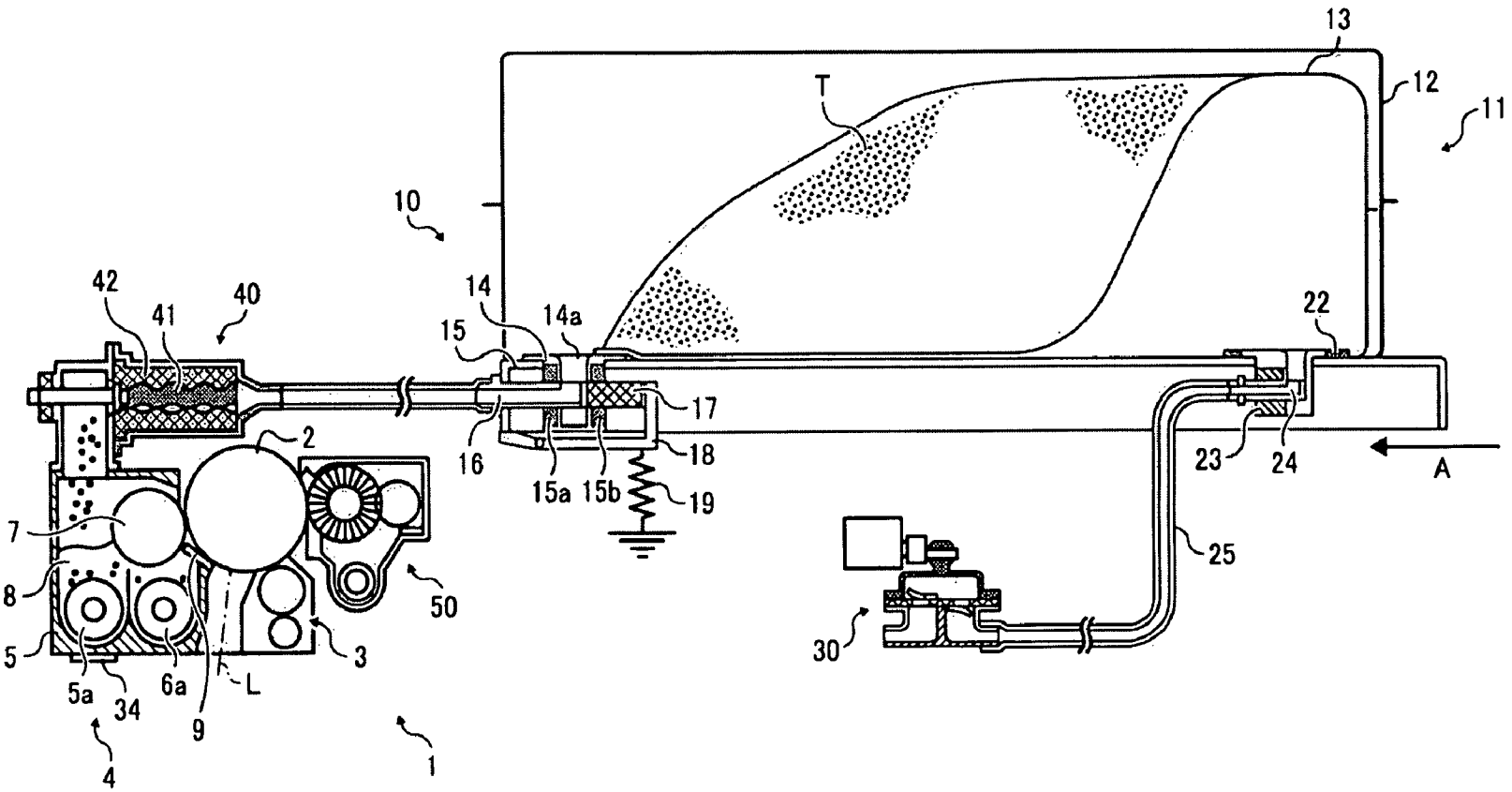
FIG. 2 is a view showing the overall constitution of an electrophotographic image forming apparatus in which an embodiment of a developer replenishing device according to the present invention is used in a toner replenishment portion.

FIG. 2 shows an example of an electrophotographic image forming apparatus using a developer replenishing device according to this embodiment in a toner replenishing portion. In the drawing, the reference numeral 2 denotes a photosensitive body. Similarly to a typical electrophotographic process, a uniform charge is applied to the photosensitive body 2 by a charging device 3, and then the photosensitive body 2 receives exposure light L corresponding to an image formed by an exposing device, not shown in the drawing, whereby an electrostatic latent image is formed thereon. The reference numeral 4 in the drawing denotes a developing device, which is a unit for forming a toner image by developing the electrostatic latent image using toner. The reference numeral 50 in the drawing is a conventional, well-known cleaning device for recovering residual toner from the photosensitive body 2 following transfer and transferring the toner to a recovery bottle, not shown in the drawing.

In this apparatus, the toner image formed on the photosensitive body 2 is transferred onto a sheet of transfer paper fed from a feeding device, not shown in the drawing, by a transfer device, not shown in the drawing (or via an intermediate transfer belt). The toner image is then fixed onto the transfer paper by a fixing device, not shown in the drawing, whereupon the image is output.

The reference numeral 5 in the drawing denotes a toner container having a substantially square or substantially rectangular front surface cross-section and formed so as to extend horizontally in the lengthwise direction. The toner container 5 is attached from the right side to the left side in the drawing. Assuming that the right side of the drawing is the front surface of the apparatus main body, for example, the toner container 5 is inserted toward the rear side from the main body front surface. A toner replenishing device 10 for replenishing toner consumed during image formation is provided in series with the developing device 4.

The developing device 4 shown in the drawing is a so-called two-component developing device that stores a developer 8 formed by mixing together a toner and a carrier. The reference symbols 5*a* and 6*a* in the drawing denote two conveyance screws for agitating the developer. Further, the reference numeral 7 in the drawing denotes a development roller having magnets of different polarities fixed to the interior thereof and a sleeve that rotates on the outer periphery thereof. The development roller 7 creates a toner image by developing a latent image while holding the agitated developer on the sleeve of the roller surface with the magnets. The reference numeral 9 in the drawing denotes a doctor blade, which is used to restrict the developer on the development roller to a fixed height.

In the developing device 4, toner is consumed steadily as image formation progresses. The developing device 4 comprises a toner concentration sensor 34 that constantly detects the toner concentration of the developer 8. When the toner concentration of the developer 8 falls below a predetermined value, control is performed to transmit an operation signal to the toner replenishing device 10.

The toner replenishing device 10 serves as a part for replenishing toner. An outside container 12 and an inside container 13 constituting the toner container 11 are flexible, bag-shaped toner storage members formed by one or more layers of a flexible sheet made of resin, such as polyethylene or nylon, or paper and having a thickness of approximately 50 to 200 μm. The reference numeral 14 in the drawing denotes a discharge mouthpiece portion provided with a toner discharge port 14*a*, which is constituted by a hard material such as resin and welded or adhered to the outside container 12 as shown in the drawing. When the same material is used for the flexible members and the rigid member, the materials do not have to be separated when the container is reused, and therefore an improvement in recycling efficiency is achieved.

New toner T is stored in the outside container 12, and when the toner T is consumed, the whole container is exchanged for a new one. The reference numeral 15 in the drawing denotes a rigid base plate made of resin or the like, which is fixed detachably to the flexible container through fitting, adhesion, or the like so that the container can be attached easily to the machine main body.

The used toner container 11 may be sent back to the maker from the user for recycling and reuse. In this case, the flexible container alone may be incinerated and used as thermal energy, and the hard members such as the base plate and mouthpiece may be reused. Incinerating members that use few natural resources and reusing components that use a lot of natural resources in this manner is an extremely effective method of recycling.

The reference numeral 22 in the drawing denotes a supply mouthpiece comprising a supply port for supplying air to the inside container 13. The supply mouthpiece 22 is constituted by a hard material such as resin, and is adhered to the inside container 13 and outside container 12 as shown in the drawing. Similarly to the discharge mouthpiece, when the supply mouthpiece 22 uses an identical material to the flexible members, an improvement in recycling efficiency is achieved.

As described above, when the toner container 11 is attached in the direction of an arrow A in the drawing by a guide member, not shown in the drawing, provided on the replenishing device main body, a discharge nozzle 16 is attached to the discharge mouthpiece 14 while pushing a discharge port shutter 17 toward the right side of the drawing. The discharge mouthpiece is provided with seals 15*a*, 15*b* which come into close contact with the discharge nozzle 16 and the shutter 17, respectively, such that a toner discharge path extending from the interior of the container to the discharge port 14*a*, a discharge tube 25, and a powder pump 40 is hermetically sealed from the outside. Thus, the powder pump 40 becomes capable of pumping the toner T through suction pressure, as will be described below. A member 18 is biased upwardly by a spring 19.

Figure 3:
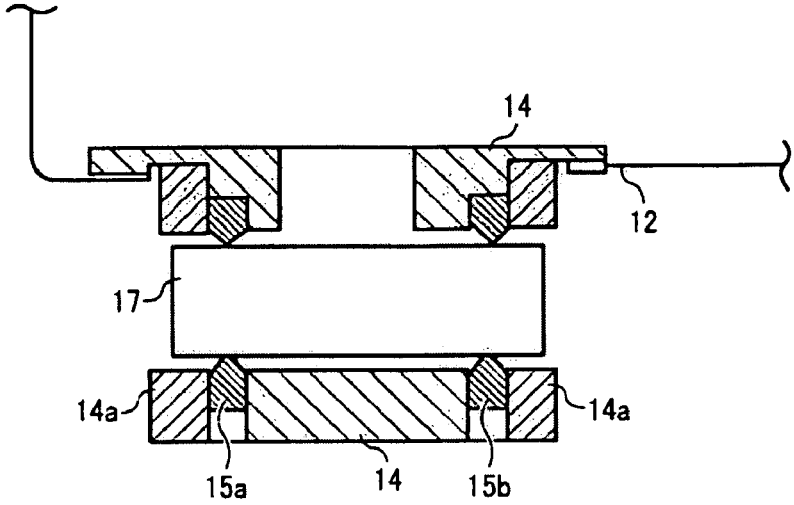
FIG. 3 is a view showing a state in which a discharge outlet shutter is attached to a toner container shown in FIG. 2.

FIG. 3 shows a state in which the discharge port shutter 17 is attached to the toner container 11 of FIG. 1 (a state prior to insertion of the shutter or when the container has been detached from the main body). When attaching the toner container 11, a supply nozzle 24 is simultaneously inserted into a slit provided in a supply port seal 23 formed from a sponge material and attached to the supply mouthpiece 22. The supply port seal 23 comes into close contact with the supply nozzle 24, similarly to the seals 15*a*, 15*b*, such that a supply path for air or the toner T extending from the supply tube 20 and supply mouthpiece 22 to the interior of the container is hermetically sealed from the outside. Thus, an air pump 30 becomes capable of supplying air. Note that the air pump 30 is a conventional, well-known diaphragm type air pump, and description thereof has been omitted.

Figure 4:
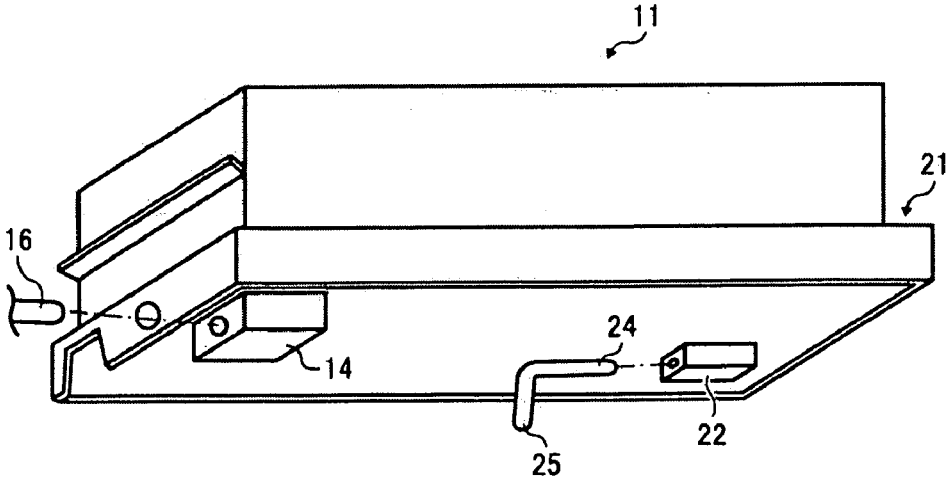
FIG. 4 is an exterior perspective view of the toner container seen from below.

FIG. 4 shows the toner container 11 from below. It can be seen from FIG. 4 that the positions of the toner discharge mouthpiece portion 14 and discharge nozzle 14*a* do not overlap the positions of the supply mouthpiece 22* and supply nozzle 24 in the lengthwise direction.

A toner discharging action of the toner replenishing device will now be described.

Figure 5:
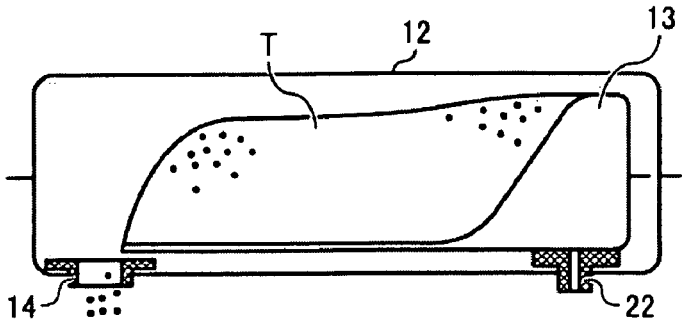
FIGS. 5 to 7 are view showing a process of supplying toner from the toner container.
Figure 6:
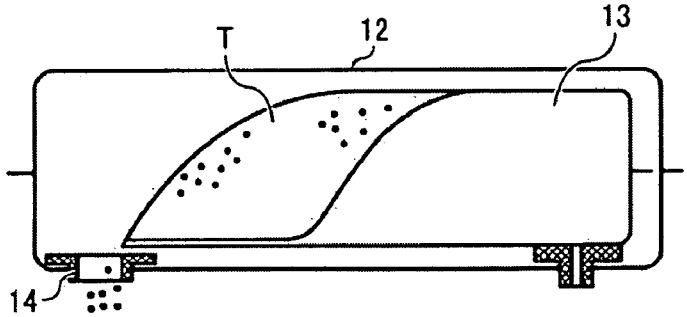
Figure 7:
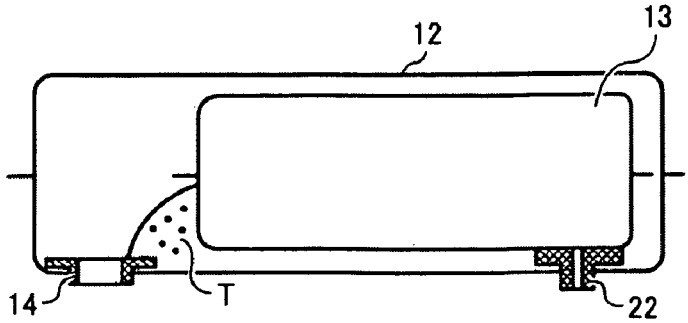

When a toner replenishment signal is issued by the toner concentration sensor 34 of the developing device 4, the air pump 30 is activated for a predetermined time period. Thus, air is supplied to the inside container 13. At the start of use, the toner is carried on top of the inside container 13 and the front surface side of the inside container 13 is pressed by the gravitational force of the toner T. The inside container 13 then gradually expands from a position near the supply port such that the toner T is pushed forward (in the supply direction) slightly in accordance with the expansion of the inside container 13. Next, the powder pump 40 is activated such that suction pressure is generated, and as a result, the toner T near the discharge port moves through the interior of the discharge tube 25 toward the left side of the drawing and is thus supplied to the developing device 4 via the powder pump 40. This operation is repeated every time a replenishment signal is issued, whereby the inside container expands gradually, as shown in FIGS. 5, 6 and 7, and the toner T moves successively toward the discharge mouthpiece portion. The amount of replenishment toner supplied each time may be controlled by adjusting the activation time of the air pump 30 and the activation time of the powder pump.

The powder pump 40 is a uniaxial eccentric screw pump formed from a rigid material such as metal or resin, and comprises a rotatable male screw-shaped rotor 41, and a stator 42 formed from an elastic material such as rubber or soft resin and having a fixed, female screw-shaped hole. The rotor and stator are separated by a predetermined space that is hermetically sealed by a predetermined amount of interlocking. When the rotor rotates, the space moves and suction pressure is generated in the resulting replenishment path, allowing the toner T to move through the replenishment path.

Second Embodiment

Figure 8:
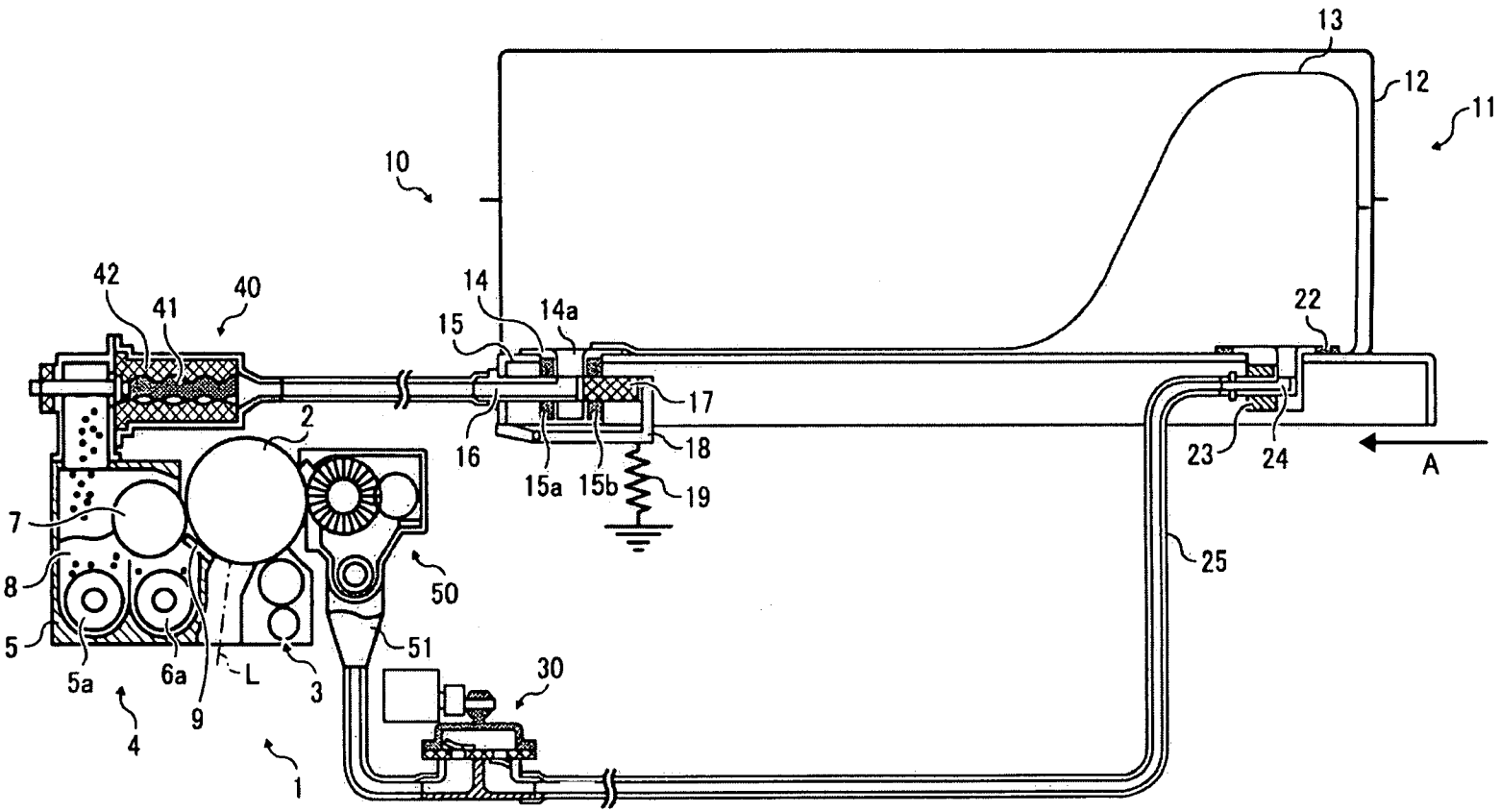
FIG. 8 is a view showing the overall constitution of an image forming apparatus in which a second embodiment of the developer replenishing device according to the present invention is used in a toner replenishment portion.

FIG. 8 shows a developer replenishing device according to this embodiment. Parts common to both FIG. 8 and FIG. 1 have been allocated identical reference symbols, and duplicate description thereof has been omitted. In this embodiment, recovered toner recovered by the cleaning device 50 are conveyed by the suction and discharge of the air pump 30 such that a mixture of toner and air is supplied to the inside container 13, and a space formed in the interior of the toner container 11 following toner discharge is used to store the recovered toner. Thus, a dedicated waste toner bottle is not required, enabling a reduce in component costs and a reduction in the size of the machine main body corresponding to the space required to provide the waste toner bottle.

Figure 9:
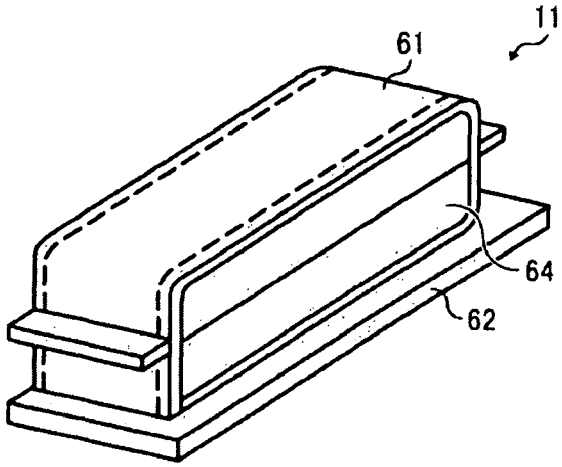
FIG. 9 is an exterior perspective view of a toner container shown in FIG. 8.
Figure 10:
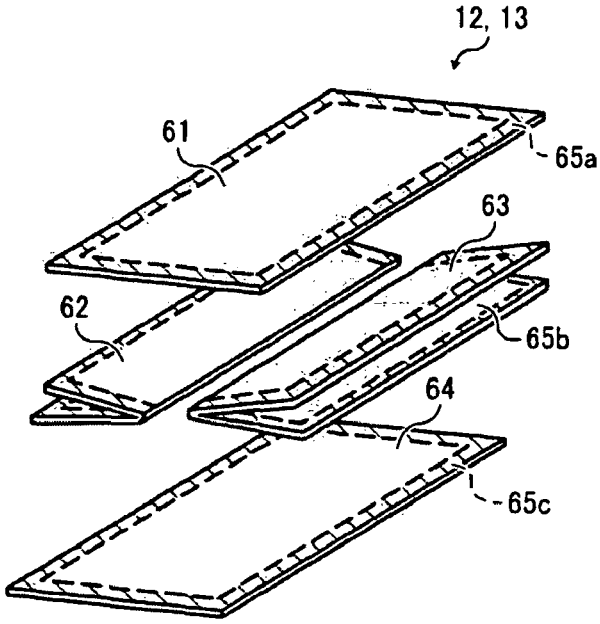
FIG. 10 is a view showing one bag container (an outside container or an inside container) of the toner container before being formed into a bag shape.
Figure 11:
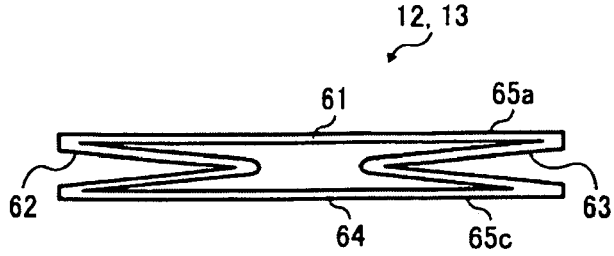
FIG. 11 is a sectional view of a sheet adhered to the bag container.

FIG. 9 shows the exterior of the toner container 11. FIG. 10 shows one of the bag containers (the outside container or the inside container) of the toner container 11 before being formed into a bag shape. The bag container is constituted by four sheets, an upper surface sheet 61, side face sheets 62, 63, and a bottom surface sheet 64. The side face sheets are folded in half and sandwiched between the upper surface and bottom surface sheets, and then the sheets laminated as shown in the drawing. The sheets are then adhered to each other by adhering or welding approximately 2 to 10 mm of the periphery (65*a*, 65*b*, 65*c*). Heat welding enables particularly easy manufacture, and is therefore used most often. FIG. 11 shows the cross-section of the adhered sheets.

Figure 12:
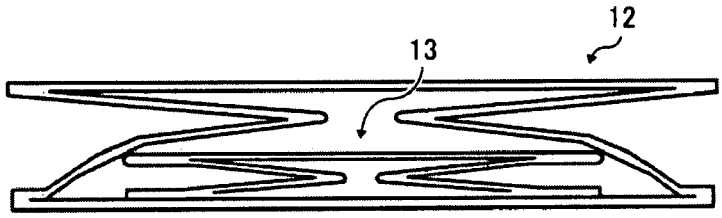
FIG. 12 is a view showing that the bag container has a duplex structure consisting of the inside container and the outside container.
Figure 13:
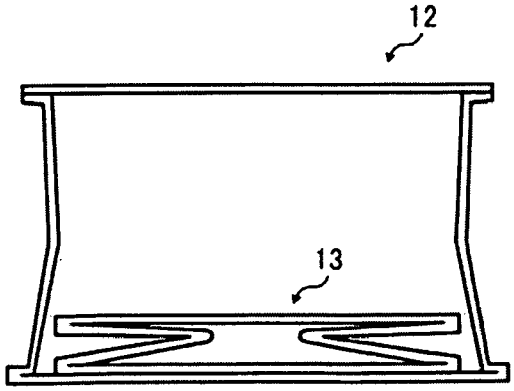
FIG. 13 is a view showing a state in which only the outside container is expanded from the state shown in FIG. 12.

In this embodiment, the inside container and outside container have a duplex structure, and therefore the inside container 13 is enveloped in the outside container 12 to form a structure such as that shown in FIG. 12. The bottom surface of the outside container 12 and the bottom surface of the inside container 13 are welded or adhered to each other so that it is possible to expand only the outside container 12 or both the outside container and inside container. FIG. 13 shows a state in which only the outside container 12 is expanded.

Third Embodiment

Figure 14:
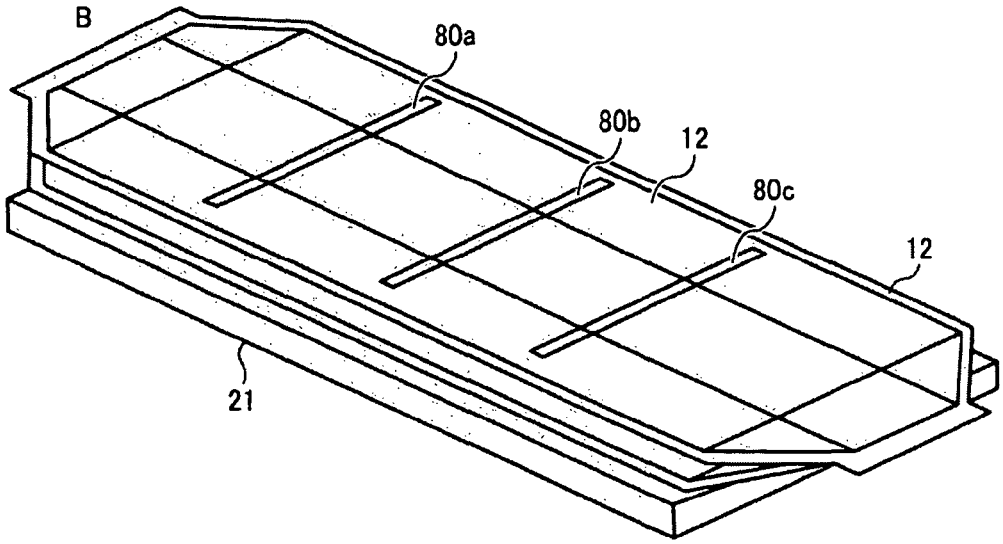
FIG. 14 is an exterior perspective view showing the constitution of a toner container according to a third embodiment of the present invention.

FIG. 14 shows the exterior of a toner container according to this embodiment. In this embodiment, three heat-welded portions 80*a*, 80*b*, 80*c* are provided such that the interior space is partitioned into four. The side of a reference symbol B in the drawing is the supply mouthpiece side, and when air or a mixture of air and toner is supplied from this side, first only the part extending from the B side to the welded part 80*a* expands. When this part expands fully, the resultant expansion pressure causes the welded part 80*a* to tear open such that the toner container expands into a connected space extending from the B side to the heat-welded portion 80*b*. When more air or toner is supplied, the heat-welded portion 80*b* also tears open such that the toner container expands into a connected space extending from B to the heat-welded portion 80*c*, and when even more air or toner is supplied, finally the heat-welded portion 80*c* tears open such that the toner container is fully expanded. Thus, the inside container 13 expands steadily and reliably from a position removed from the discharge port, and therefore all of the toner T in the outside container 12 is discharged reliably without becoming trapped between the inside container 13 and the upper surface of the outside container 12. As a result, a superior toner replenishing device in which no toner remains after use can be realized.

Various modifications will become possible for those skilled in the art after receiving the teachings of the present disclosure without departing from the scope thereof.

What is claimed is:

1. In a developer replenishing device which is provided with a developer container storing a developer used in an image forming apparatus, and which replenishes a developing device of the image forming apparatus with the developer in the developer container, the developer container is rectangular in a horizontal direction, and comprises an outside container storing unused developer and a deformable inside container enveloped by the outside container, and the developer replenishing device comprises:

a developer discharge port, provided in the outside container, for discharging the developer from the interior of the outside container;

an air supply port for introducing air into the inside container; and an air supplying device for supplying air to the air supply port.

2. The developer replenishing device as claimed in claim 1, wherein the developer discharge port is provided in a lengthwise direction end portion of the outside container, and the air supply port is provided in an opposite side end portion to the developer discharge port in the lengthwise direction.

3. The developer replenishing device as claimed in claim 1, wherein recovered toner obtained by recovering toner remaining on a photosensitive body of the image forming apparatus following transfer is conveyed into the inside container by the air supplying device through the air supply port.

4. The developer replenishing device as claimed in claim 1, wherein the air supplying device includes a uniaxial eccentric screw pump and an air pump for supplying air to an outlet of the uniaxial eccentric screw pump.

5. The developer replenishing device as claimed in claim 1, wherein the developer container is attached and detached through insertion and withdrawal in a substantially horizontal direction, the developer discharge port and the air supply port are disposed so as not to overlap in an attachment/detachment direction, and when attaching and detaching the developer container, the developer discharge port and the air supply port are fitted to a discharge nozzle and an air nozzle of the developer replenishing device.

6. The developer replenishing device as claimed in claim 1, wherein at least one of a weld and an adhesive is disposed in a plurality of locations in a lengthwise direction of the inside container and in a right-angled direction to a lengthwise direction of an upper surface and a bottom surface thereof such that the upper surface and the bottom surface are held together at a predetermined pressure resistance.

7. The developer replenishing device as claimed in claim 6, wherein a maximum generated pressure of the air supply device is equal to or greater than the pressure resistance of the adhered or welded portions.

8. The developer replenishing device as claimed in claim 1, wherein a rigid base plate is fixed detachably to a bottom surface of the developer container, and the base plate is fixed by fixing the developer discharge port and the air supply port to the base plate.

9. The developer replenishing device as claimed in claim 1, wherein the inside container and the outside container are bag containers formed in a bag shape using a resin sheet, and the inside container is constituted by a thinner sheet than the outside container.

10. The developer replenishing device as claimed in claim 1, wherein the developing device comprises developer discharge amount detecting means for detecting a developer discharge amount discharged from the developer container, and control means for controlling an activation time of the air supplying device according to a detection result of the developer discharge amount detecting means, estimates a recovered developer amount from a developer replenishing amount detection result, and activates conveying means in accordance with the estimated value of the recovered developer amount.

11. The developer replenishing device as claimed in claim 1, further comprising developer suction conveying means for discharging the developer through the discharge port by suction and conveying the developer to the developing device.

12. The developer replenishing device as claimed in claim 11, wherein the developer suction conveying means is a uniaxial eccentric screw pump.

13. In a developer container for storing a developer used in an image forming apparatus, the developer container is rectangular in a horizontal direction, and comprises an outside container storing unused developer and a deformable inside container enveloped by the outside container, and further comprises:

a developer discharge port, provided in the outside container, for discharging the developer from the interior of the outside container; and an air supply port for introducing air into the inside container.

14. In an image forming apparatus using a developer replenishing device, the developer replenishing device is provided with a developer container storing a developer used in the image forming apparatus, and replenishes a developing device of the image forming apparatus with the developer in the developer container, the developer container is rectangular in a horizontal direction, and comprises an outside container storing unused developer and a deformable inside container enveloped by the outside container, and the developer replenishing device comprises:

a developer discharge port, provided in the outside container, for discharging the developer from the interior of the outside container;

an air supply port for introducing air into the inside container; and an air supplying device for supplying air to the air supply port.

15. A developer container comprising:

a first chamber for storing a developer;

a second chamber provided below the first chamber;

a deformable partition for dividing the first chamber from the second chamber;

a developer discharge port provided in the first chamber for discharging the developer from the first chamber; and a filler supply port for introducing a filler which is air into the second chamber.

16. A developer container as claimed in claim 15, wherein the second chamber is enveloped by the first chamber.

17. A developer replenishing device comprising:

a developer container comprising a first chamber for storing a developer, a second chamber provided below the first chamber, a deformable partition for dividing the first chamber from the second chamber, a developer discharge port provided in the first chamber for discharging the developer from the first chamber, and a filler supply port for introducing a filler which is air into the second chamber; and a filler supplying device for supplying the filler which is air to the second chamber.

18. An image forming apparatus comprising:

a developer container comprising a first chamber for storing a developer, a second chamber provided below the first chamber, a deformable partition for dividing the first chamber from the second chamber, a developer discharge port provided in the first chamber for discharging the developer from the first chamber, and a filler supply port for introducing a filler which is air into the second chamber; and a filler supply device for supplying the filler which is air to the second chamber.

* * * * *